US005492280A

United States Patent [19]

Corres et al.

[11] Patent Number: 5,492,280

[45] Date of Patent: Feb. 20, 1996

[54] PALLET FOR TRANSPORTING A TEXTILE BOBBIN OR TUBE RELATIVE TO A TEXTILE MACHINE

[75] Inventors: Norbert Corres, Wassenberg; Rudolf Perlitz, Moenchengladbach, both of Germany

[73] Assignee: W. Schlafhorst AG & Co., Moenchengladbach, Germany

[21] Appl. No.: 142,179

[22] Filed: Oct. 25, 1993

[30] Foreign Application Priority Data

Oct. 24, 1992 [DE] Germany ..... 42 36 038.2

[51] Int. Cl.[6] ..... B65H 49/02; D03J 5/08

[52] U.S. Cl. ..... 242/130; 242/129.5; 242/571.3; 242/571.4; 242/571.5

[58] Field of Search ..... 242/129.5, 46.5, 242/46.4, 571.3, 571.4, 571.5, 597.6, 164, 130

[56] References Cited

U.S. PATENT DOCUMENTS

| | | | |
|---|---|---|---|
| 3,006,565 | 10/1961 | Pelletier | 242/72 |
| 3,292,874 | 12/1966 | Tinkham | 242/571.5 |
| 3,456,892 | 7/1969 | Krumbein et al. | 424/571.5 |
| 3,811,636 | 5/1974 | Muchnick | 242/129.5 |
| 4,149,682 | 4/1979 | Gustafson et al. | 242/571.3 |
| 5,279,470 | 1/1994 | Birkmann et al. | 242/571.4 |

FOREIGN PATENT DOCUMENTS

| | | |
|---|---|---|
| 500052 | 6/1930 | Germany . |
| 2006381 | 9/1970 | Germany . |
| 2405796A1 | 8/1975 | Germany . |
| 2249840B2 | 7/1976 | Germany . |
| 3235442A1 | 4/1983 | Germany . |
| 3426655C2 | 9/1988 | Germany . |
| 3908487C2 | 9/1989 | Germany . |
| 3925987A1 | 2/1991 | Germany . |
| 4016466A1 | 11/1991 | Germany . |
| 4015173A1 | 11/1991 | Germany . |
| 4110284A1 | 10/1992 | Germany . |
| 4131527A1 | 3/1993 | Germany . |
| 3-8678 | 4/1991 | Japan . |
| 1383775 | 2/1975 | United Kingdom . |

*Primary Examiner*—William Stryjewski
*Attorney, Agent, or Firm*—Shefte, Pinckney & Sawyer

[57] ABSTRACT

A pallet for transporting a textile cop or tube in a textile machine transport system accommodates tubes of differing inside diameters by providing at least three independently radially positionable support elements spaced circumferentially about a tube-support spindle and extending parallel to the longitudinal axis of the spindle and at least one resilient element acting radially outwardly on the support elements. The support elements are formed as fins that extend through slots in the spindle and are acted upon by torsion bars springs which spring-load adjacent fins in alternation. When textile yarn tubes are mounted on the spindles, the retaining force of the spindle increases steadily and attains its maximum once the tube is fully mounted.

27 Claims, 5 Drawing Sheets

PALLET FOR TRANSPORTING A TEXTILE BOBBIN OR TUBE RELATIVE TO A TEXTILE MACHINE

FIELD OF THE INVENTION

The invention relates to pallets for supporting and transporting textile bobbins and tubes, particularly pallets of the type having a base plate, a spindle or pin extending therefrom, and a radially resilient element.

BACKGROUND OF THE INVENTION

German Offenlegungsschrift DE-OS 32 35 442 discloses an automatic bobbin winding machine in which yarn cops and empty cop tubes are circulated on individual pallets, sometimes referred to as peg trays. During their presence in processing stations and over major portions of the transport system, the cops and tubes remain on these pallets.

It is known that in preparation for the cop unwinding process in a bobbin winder, cops must be rotated about their longitudinal axis so that the leading end of the yarn can be located and placed in a ready position. To that end, drive wheels are in many cases disposed to frictionally engage with the cop base to transmit the rotary motion directly to the cop. In the apparatus of DE-OS 32 35 442, each pallet is held by retaining elements to prevent its rotary motion. A driven friction wheel pivots against the base of the cop and rotates the cop on the spindle of the pallet. Any yarn windings that may be present at the base of the cop are clamped by the friction wheel and as a result cannot come loose. To prevent the friction wheel from contacting the main yarn package of the cop, the friction wheel must be positionable quite close and very accurately.

In a winder described in German Patent DE 39 25 987, the pallet is driven, with the rotary motion being transmitted to the cop by tilting the cop. Although this technique improves the transmission of the rotary motion, at the same time, it results in increased frictional wear at the tip of the cop.

It is also known, in individual cop processing stations, to engage clamping elements outwardly against the cop base in order to keep the cop firmly held on the spindle of the pallet when upwardly oriented vertical forces are being exerted. Such clamping elements are described in German Patent 34 26 655 for a yarn end preparation device and in German Patent DE 39 08 487 A1 for a winding station. For that purpose, clamping and triggering elements are required at each processing station. In each case, the danger exists that yarn windings may also be clamped, which causes damage to them or can directly cause yarn breakage in the winding position.

In the case of transport paths that proceed over various levels, as described for instance in German Patent DE 40 15 173 A1, the pallets with the cops or tubes are tipped, which creates the danger that the cops or tubes may slide off the spindles of the pallets in response to external factors or from a change of the direction of movement.

German Patent DE 40 16 466 A1 discloses a textile machine which circulates pallets whose spindles have at least one elastic element on its circumference in order to securely hold or carry the textile bobbin or tube. The elastic element has sufficient resiliency to exert a radially outward force relative to the longitudinal axis of the spindle. Although the spindles of the pallets have the advantage over the pallets initially discussed above that the cop is securely fixed on the spindle, i.e., the cop cannot readily be doffed from the pallet and also rotates unitarily with the pallet, these pallets nevertheless share the disadvantage that the various pallets can be used only for a very specific bobbin size with a predetermined inside tube diameter. A further disadvantage is that wide tolerances in a batch of bobbins or deformation of the bobbin tubes result in considerable differences in the tube clamping force achieved.

SUMMARY OF THE INVENTION

It is therefore an object of the present invention to provide an improved pallet of the general type of German DE 40 16 466 A1 which is capable of securely fixing thereon textile bobbins and tubes of varying inside diameters.

Briefly summarized, the pallet of the present invention basically comprises a disklike base plate and a spindle extending centrally from the base plate for supporting a textile yarn tube, with at least three support elements spaced circumferentially about the spindle and extending substantially parallel to its longitudinal extent for independent radial positioning movement relative to the spindle and at least one element having resiliency in a direction radially with respect to the longitudinal extent of the spindle for urging the support elements radially outward from the spindle, but being yieldable to permit radially inward withdrawal of the support elements, thereby to accommodate mounting of the spindle with yarn tubes of varying internal diameters.

The pallet of the present invention separates the function of producing a frictional force between support elements of the spindle and the inside surface of the textile yarn tube and the function of attaining a resilient force outwardly which provides a better ability to adapt the separate components used for these purposes to their various functions. Thus, the support elements of the present pallet may be made from a strong, substantially incompressible material, while the resilient element or elements need merely to perform essentially the function of elasticity or resiliency. By using at least three support elements distributed over the circumference of the spindle, satisfactory centering of the textile yarn tube itself is attached whenever the tube has any deformation. Above all, major differences in clamping force, with ensuing problems in mounting and doffing the textile yarn tubes, are avoided.

Depending on the freedom of motion of the support elements, the same pallets or spindles may be used for different batches of textile yarn tubes which have inside diameters that differ from one another. Hence, upon a cop batch change, the time consuming replacement of all the pallets in the transport system is unnecessary. Moreover, if different batches are processed on the same bobbin winding machine, the same pallets can be used for all the batches being processed. If electrically readable, erasable and encodable memory chips are used in the pallets, then the encodings are adapted to the particular batch originating in the newly mounted textile bobbin.

Since the support elements extend substantially longitudinally of the spindle, very good centering of the textile tube on the pallet is achieved as a result of these support elements alone.

In the preferred embodiment of the present pallet, the spindle is formed with slots and the support elements are formed as fins which extend through the spindle slots, each fin having stops which cannot pass through the respective slot so as to limit radially outward movement of the fins. These stops on the support fins enable precise, simple definition of the outer circumference of the spindle, according to the disposition of the fins when the spindle is not carrying any textile yarn tube. The stops of the fins are kept pressed against the spindle by the resilient element. Disposition of the stops at the top and bottom ends of the fins is sufficient to hold the fins firmly over their entire length.

Depending on the particular construction of the pallet, the stops may be embodied as prolongations or widenings of the fins or optionally as a combination thereof.

Within the scope of the invention, it is possible for a single elastic body disposed in the interior of the spindle to act upon all the support elements or alternatively for separate resilient elements to be provided for the individual support elements. In the latter case, it is advantageous for adjacent support elements to be connected alternately at their top and bottom ends by torsion bar springs. This simple construction assures that each support element can be pressed at its opposite top and bottom ends through the respective opening of the spindle with different forces, completely independently of one another, which makes it possible to compensate for different conicities of the textile yarn tubes and for tube deformation.

DESCRIPTION OF THE PREFERRED EMBODIMENT

Figure 1:
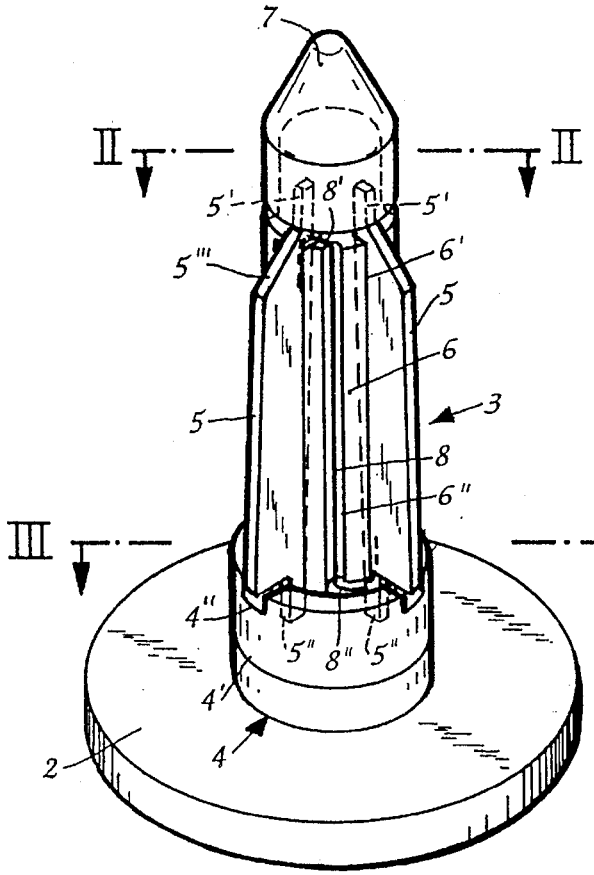
FIG. 1 is a perspective view of a pallet according to one embodiment the present invention.
Figure 2:
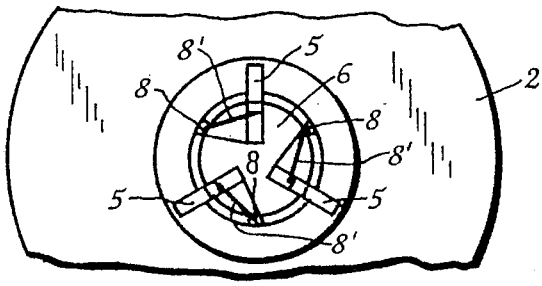
FIG. 2 is a cross-sectional view taken along the line II—II through the spindle of the pallet of FIG. 1.
Figure 3:
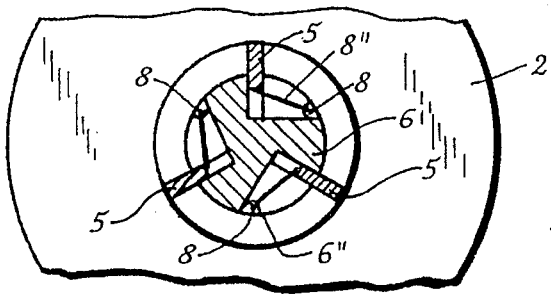
FIG. 3 is another cross-sectional view taken along the line III—III through the spindle of the pallet of FIG. 1.
Figure 4:
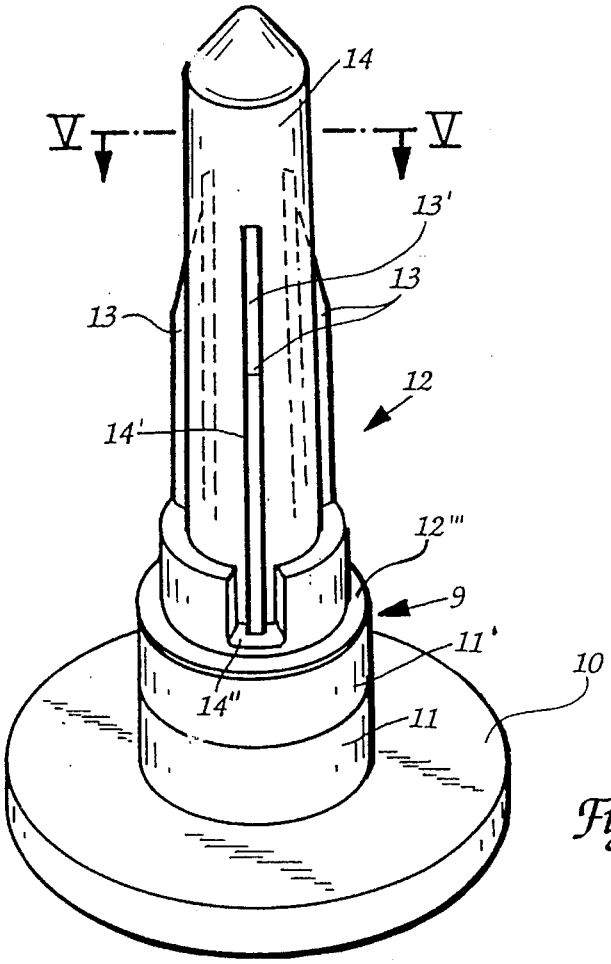
FIG. 4 is a perspective view of another embodiment of the pallet of the present invention.
Figure 5:
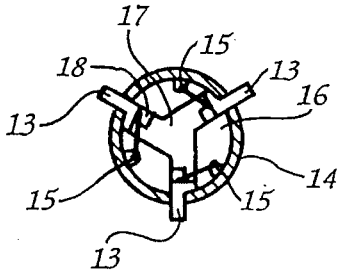
FIG. 5 is a cross-sectional view taken along the line V—V through the spindle of the pallet of FIG. 4.
Figure 6:
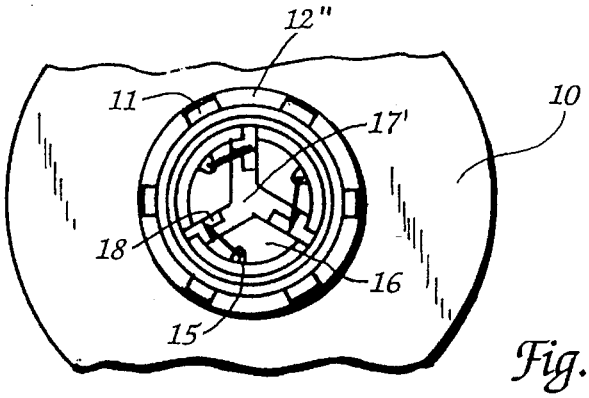
FIG. 6 is a bottom plan view of the pallet shown in FIG. 4.

The pallet of FIGS. 1–3 has a base plate 2 by which it rests on moving conveyor surfaces that frictionally carry it along transport paths of a textile machine transport system. Typically, the size of this base plate 2 is such that the pallet 1 rests securely when a textile bobbin, such as a yarn cop (not shown) or an empty cop or bobbin tube is mounted on it.

The pallet 1 has an upstanding spindle 3 extending outwardly from the center of the base plate 2 for mounting the textile cop or bobbin with its tube. A pedestal 4 is disposed between the spindle 3 and the base plate 2 to serve along the transport paths as a guide for the pallet 1 or as a bearing surface for stop elements. One component of this pedestal 4 is a pedestal ring 4', which has spaced radial slots 4" on its upper edge to allow the passage of fins 5 through the slots 4".

The spindle 3 has a spindle body 6 anchored in the base plate 2. This spindle body 6 has longitudinally extending slotlike openings 6' through which the fins 5 extend radially. A spindle head 7, formed essentially as a hollow body, is mounted on the upper end of the spindle 3.

The fins 5 have longitudinally-projecting prolongations 5' on their respective upper ends and similar longitudinally-projecting prolongations 5" on their respective lower ends. The radially outward edges of the upper prolongations 5' abut the inside surface of the hollow spindle head 7, while the radially outward edges of the lower prolongations 5" abut the inside surface of the pedestal ring 4'. In this position, as shown in FIGS. 1–3, the maximum effective diameter of the spindle 3, formed collectively by the radially outer edges of the fins 5, is achieved.

This position of the fins 5 is effected by torsion bar springs 8, which have relatively small upper spring arms 8' and lower spring arms 8" which press against the radially inward edges of the fins 5.

The torsion bar springs 8 are disposed in longitudinal recesses 6" formed in the spindle body 6. Each recess 6" is located between two adjacent slotlike openings 6' into which the fins 5 are inserted. The spring arms 8',8" of each spring 8 act in alternation on the two adjacent fins 5 on either side of the spring 8. In this manner, with three torsion bar springs 8, the three fins 5 can be engaged both at their top and the bottom ends essentially independently of one another.

This spring biasing of both ends of the fins 5 has the effect that these fins 5 are each movable freely and resiliently between two stop points, in each case within a plane of motion which intersects the longitudinal axis of the spindle 3 (see FIGS. 2 and 3). The inner stop point is defined by the depth of the openings 6'. Hence displacement of a fin 5 inwardly adjacent its upper end region has no effect, or has an effect only in a change in inclination, on the lower end region of the fin 5. As a result, it is possible to attain a virtually equal gripping action for various textile yarn tubes even if the tubes differ in conicity. In each case, the outer edges of the fins 5 engage along substantially their entire length, except for an oblique inclined respective textile tube.

The connection of adjacent fins 5 alternatively by means of shared torsion bar springs 8 provides another advantage of the invention. First, before a textile bobbin is mounted, all the fins are urged into their outermost positions. The torsion bar springs 8 are accordingly least deflected and most relaxed in this position. When the textile tube is then mounted from above onto the spindle 3 and moved past the oblique edges 5'" of the fins 5, the fins are initially pivoted inward solely in their upper end region, in the course of which the tube gripping force of the torsion bar springs 8 is first varied from the relaxed position of to a partially loaded position. As the textile tube continues to be slipped onto the spindle 3, the fins 5 are increasingly displaced in their lower region as well in the direction of the center axis of the spindle 3 within the openings 6'. The lower spring arms 8" are also pivoted, but in the opposite direction from the upper spring arms 8'. As a result, the tube gripping force of the torsion bar springs 8 increases in their upper region as well, which progresses to a maximum spring-loaded tube gripping force of the torsion bar springs 8 when the tube is fully mounted on the spindle. This steadily increasing clamping force of the fins against the interior of the textile tube during the mounting process enables tubes to be easily slipped onto the spindle without jerking or excessive force, but also ultimately accomplishes a maximized gripping force of the spindle 3 of the pallet 1.

Depending on the depth of the openings 6' or the length of the fins 5 and the dimensioning of the other component parts, it is possible for the spindle 3 not only to compensate easily for differences in sizes of textile yarn tubes including tube deformations, but also to use the same spindle for different batches with more or less different inside tube diameters. As long as the inside dimensions of the textile tubes vary between the two extreme positions of the fins 5, not only is an adequate clamping force attained, but also seizing of the tubes on the spindles is avoided.

FIGS. 4–7 show a further embodiment of the invention, which operates for the most part equivalently to the first embodiment of FIGS. 1–3. The pallet 9 has a base plate 10 and a pedestal 11 with a pedestal ring 11'. The spindle 12 has a tubular body 14 that is closed at its upper outer end. The spindle 12 can be interchangeably inserted into the pedestal 11 of the pallet 9. To that end, the spindle 12 has claws 12" on the lower end of its foot 12' that engage behind a shoulder in the pedestal 11, as can be seen essentially from FIGS. 6 and 7. A more detailed description is unnecessary, since interchangeable spindles for pallets of this kind have already been described in German Patent Application P 41 31 527.8, which also describes the possibility of inserting a memory chip into the hollow space formed at the foot of the interchangeable spindle. In this way, suitable information about the applicable batch can be stored in memory, making the pallet usable for different batches and for the information exchange necessary for that purpose. A flange 12" adjacent the foot 12' abuts the pedestal ring 11' when the spindle 12 is fixed in place on the pedestal 11.

Slotlike openings 14' are milled into the tubular body 14, while an additional recess 14" is also formed on its lower end.

Fins 13 extend through the openings 14' and are supported in guide slots 18 in a spindle body 16 inserted into the tubular body 14. In this embodiment, the fins 13 also have oblique inclined edges 13', which are intended to make it easier to mount the textile tubes. Torsion bar springs 15 are disposed analogously to the first embodiment of FIGS. 1–3 in longitudinal recesses 19 of the spindle body 16 and have relatively small upper and lower spring mounting arms 15',15" for alternating connection to the adjacent fins 13.

Figure 7:
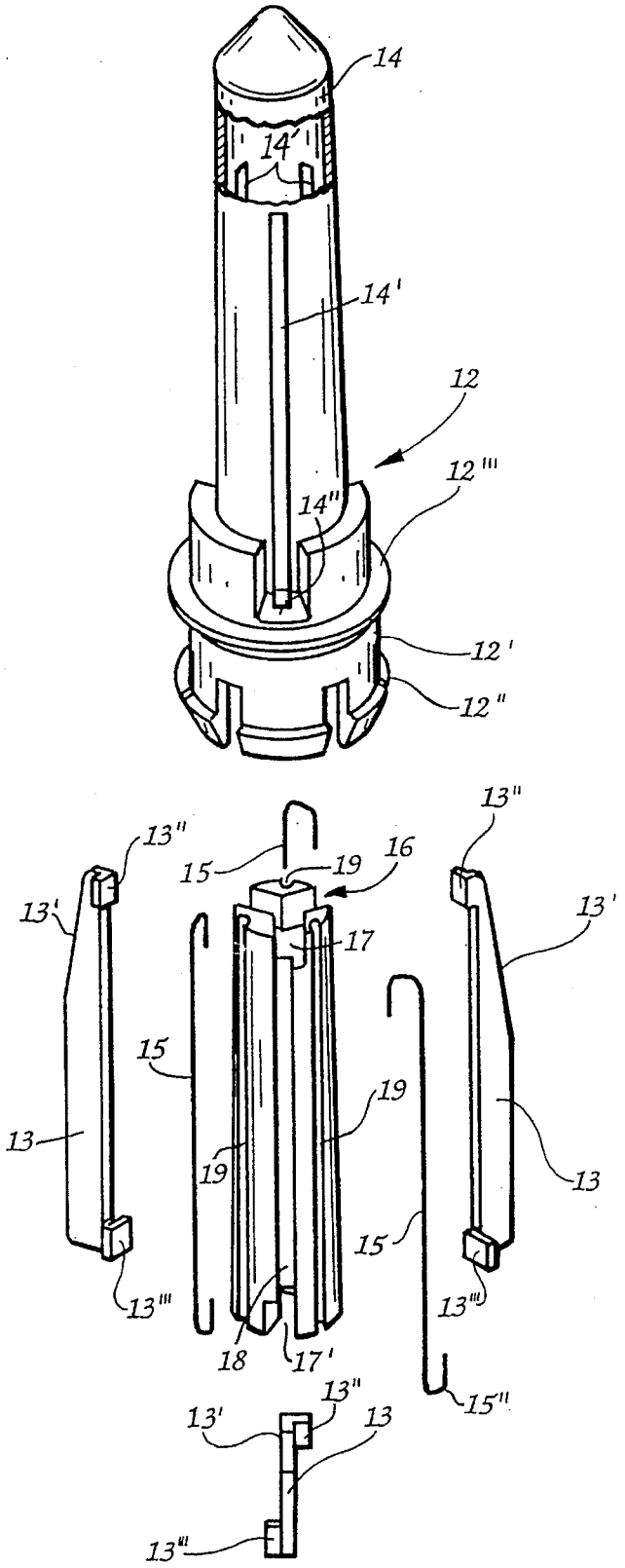
FIG. 7 is an exploded view of the spindle of the pallet of FIGS. 4–6.

As seen particularly from the exploded view in FIG. 7, the fins 13 are provided with upper and lower laterally widened tabs 13",13'". These widened tabs 13",13'" for the most part 5 in the first embodiment of FIGS. 1–3. They form a stop for the fins 13 to engage the interior of the tubular body 14. These tabs 13",13'" have the additional function of lending the spring arms 15',15" broad guidance in the various positions of the fins 13 In this way, even a relatively long path of movement by the fins 13 within the fin guide slots 18 in the spindle body 16 can be achieved.

In order to provide space for these tabs 13",13'" upon inward displacement of the fins 13, the spindle body 16 also has upper and a lower slotted star-shaped end portions 17,17', which defined slots of sufficient width to accommodate the tabs.

Figure 8:
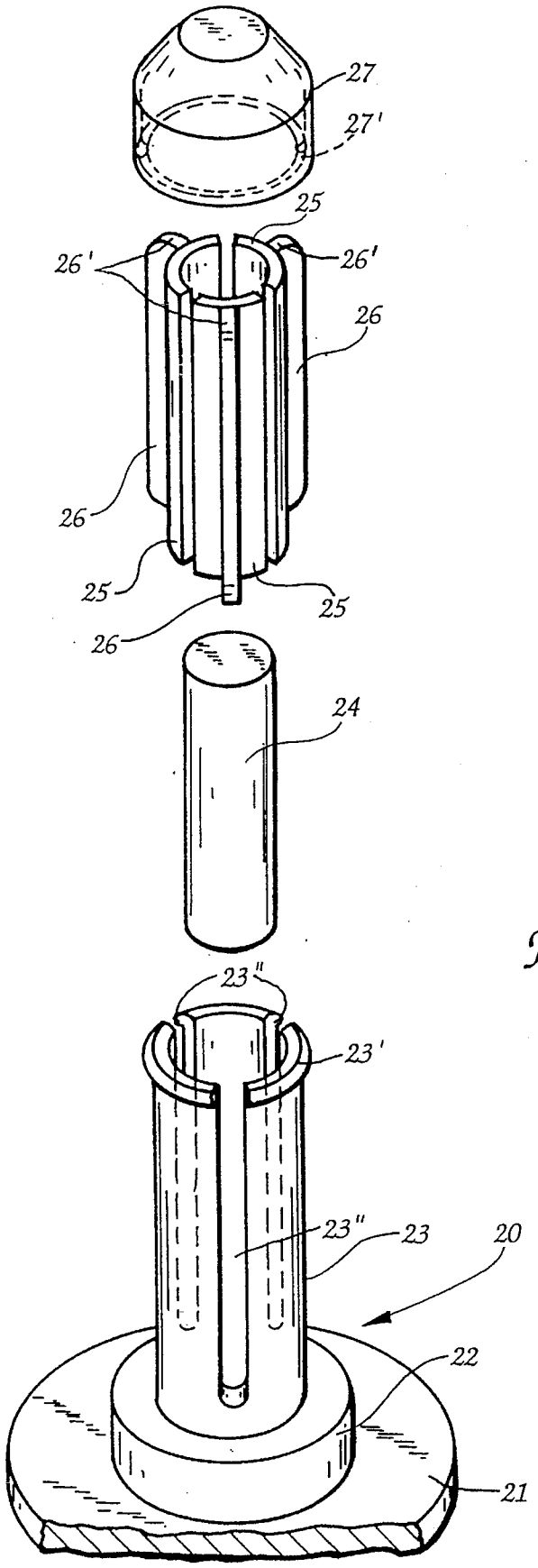
Fig. 8 is an exploded perspective view of another embodiment of the pallet of the present invention.

In another embodiment of the pallet of the present invention shown in FIG. 8, an elastic body 24, e.g., of foam rubber, is provided for gripping all three fins 26. The pallet 20 again has a base plate 21 and pedestal 22. Above the pedestal 22 is a tubular spindle body 23, which has a flange 23' at its upper edge interrupted by slotlike openings 23" extending longitudinally along the tubular body 23.

The fins 26 are affixed to arcuate segments 25 having the same curvature on their outer surfaces as the tubular body 23 has on its interior surface.

In the relaxed state of the pallet, i.e., when no textile yarn tube is mounted on the spindle of the pallet, the segments 25 are urged into engagement against the inner wall of the tubular body 23 by the elastic body 24. The outer edges of the fins 26 then define the maximum diameter of the spindle. The fins 26 are guided through the openings 23, and as a result, the position of the segments 25 is also defined.

Once the elastic body 24 and the segments 25 have been inserted into the tubular body 23, a spindle head 27 is affixed over the flange 23' of the tubular body 23. To that end, the spindle head 27 has an annular inner slot 27', into which the flange 23' locks in place, which is readily possible because the openings 23" permit the tubular body 23 to yield inwardly.

This embodiment of the pallet of the present invention involves a very simple construction, and it is also assured that a textile tube sliding on the rounded end portions 26' of the fins 26 will gradually counter the resistance of the elastic body 24 and displace the fins 26 radially inwardly over the their entire length. Hereagain, the clamping force exerted by the fins under the biasing force of the elastic body 24 increases continuously as the textile tube is progressively placed on the spindle. Hence, just as in the preceding example, the attendant advantages are present, both when the textile tubes are mounted and doffed and during transport and in processing stations.

Figure 9:
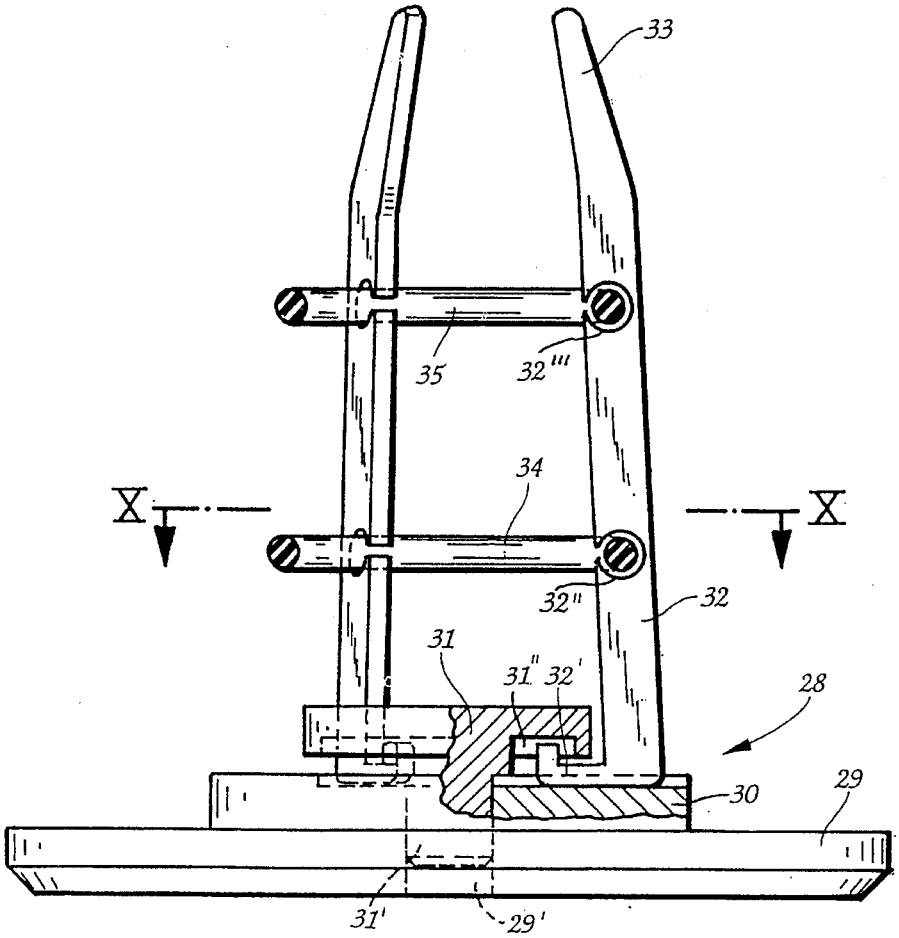
FIG. 9 is a side elevational view, partially sectioned, of a further embodiment of the pallet of the present invention.
Figure 10:
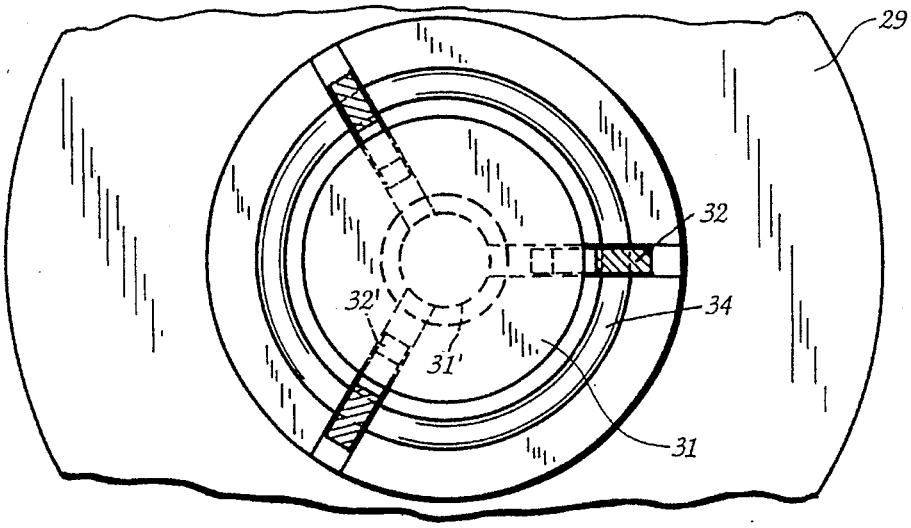
FIG. 10 is a cross-sectional view taken through the line X—X of the spindle of the pallet of FIG. 9.

A fourth embodiment of a pallet according to the present invention is shown in FIGS. 9 and 10. A pallet 28 has a base plate 29 and a pedestal 30. A bore 29' is formed completely through the base 30 into the base plate 29 and receives a pin 31' of a retainer 31, the pin 31' being secured in the bore 29' by a slot and flange connection. In this embodiment, support elements 32 are held by two O-rings 34,35 formed of a resilient material, preferably a metal material. The support elements 32 each have a foot 32', in the form of a hook, which foot 32 is received in a slot 31" in the underside of the upper end of the retainer 31.

The hooklike form of the feet 32' of the support elements 32 thus secures the support elements against outward pivoting at the lower ends of the support elements 32. Inserting the feet 32' into the slots 31" also assures retention of the support elements 32 securely against relative motion.

The 0-rings 34,35 are inserted into openings 32",32'" formed in the support elements 32 that open radially inwardly. The openings 32", 32'" are narrower at the inward side than the diameter of the 0-rings 34,35, whereby the support elements 32 cannot readily be pulled off the O-rings 34,35.

The pallet 28 can be assembled in a very simple manner. First, the support elements 32 are joined together by means of the 0-rings 34,35, with the 0-rings being introduced through the openings into the bores 32", 32'", where they lock into place Next, the combined structure of the support elements 32 and the O-rings 34,35 is mounted on the pedestal 30 of the pallet 28. Last, the retainer 31 is mounted to the base plate 29 with the fastening pin 31' inserted into the bore 29' as the feet 32' of the support elements 32 are received in the slots 31". The fastening pin 31' thereby locks into place in the base plate by the aforementioned slot and flange connection.

The support elements 32 also have chamfers 33 at their upper ends, which make it easier to mount a textile yarn tube. The possibility also exists of placing a spindle head (not shown) onto the upper ends of the support elements 32 to provide further stability.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A pallet for transporting a textile yarn tube relative to a textile machine, comprising a disk-like base plate, a spindle extending centrally from the base plate for supporting the tube, at least three support elements spaced circumferentially about the spindle and extending substantially parallel to the longitudinal extent of the spindle, the support elements being independently positionable radially relative to the spindle, and a plurality of torsion bar springs corresponding in number to the plurality of support elements, the torsion bar springs being disposed between and substantially parallel to the supporting elements, each spring having arms at its opposite ends extending in opposite directions to engage the adjacent pair of support elements for providing resiliency in a direction radially with respect to the longitudinal extent of the spindle for urging the support elements radially outwardly from the spindle.

2. The pallet of claim 1 wherein the spindle defines slots and the support elements comprise fins which extend through the spindle slots, each fin having stops which cannot pass through the respective slot to limit radially outward movement of the fins.

3. The pallet of claim 2 wherein the stops comprise extending portions at opposite ends of the fins.

4. The pallet of claim 2 wherein the stops comprise lateral enlargements of the fins.

5. The pallet of claim 1 wherein the support elements are tapered at an outward end of the spindle opposite the base plate to facilitate mounting the textile yarn tube.

6. The pallet of claim 1, further comprising means for supporting each torsion spring essentially against radially inward deflection and against lateral deflection between its said ends.

7. A pallet for transporting a textile yarn tube relative to a textile machine, comprising a disk-like base plate, a spindle extending centrally from the base plate for supporting the tube, at least three support elements spaced circumferentially about the spindle and extending substantially parallel to the longitudinal extent of the spindle, the support elements being independently positionable radially relative to the spindle, and a plurality of elongate resilient elements extending parallel to the support elements, each resilient element connected to two support elements for resilient urging the two support elements radially outwardly from the spindle.

8. The pallet of claim 7, further comprising means for supporting each resilient element essentially against radially inward deflection and against lateral deflection except at its opposite ends.

9. The pallet of claim 7 wherein each resilient element has one end thereof connected to one support element and an opposite end thereof connected to another support element.

10. The pallet of claim 9, further comprising means for supporting each resilient element essentially against radially inward deflection and adjacent lateral deflection between its said ends.

11. The pallet of claim 7 wherein each said resilient element is a bar spring.

12. The pallet of claim 7 wherein each said resilient element is a torsion spring.

13. The pallet of claim 7 wherein each resilient element is disposed between two adjacent support elements with said ends of each resilient element connected to the two adjacent support elements.

14. The pallet of claim 13 wherein said ends of each resilient element comprise arms which extend in laterally opposite directions from one another.

15. The pallet of claim 7 wherein the spindle defines slots and the support elements comprise fins which extend through the spindle slots, each fin having stops which cannot pass through the respective slot to limit radially outward movement of the fins.

16. The pallet of claim 15 wherein the stops comprise extending portions at opposite ends of the fins.

17. The pallet of claim 15 wherein the stops comprise lateral enlargements of the fins.

18. The pallet of claim 11 wherein the support elements are tapered at an outward end of the spindle opposite the base plate to facilitate mounting the textile yarn tube.

19. A pallet for transporting a textile yarn tube relative to a textile machine, comprising a disk-like base plate, a spindle extending centrally from the base plate for supporting the tube, at least three support elements spaced circumferentially about the spindle and extending substantially parallel to the longitudinal extent of the spindle, the support elements being independently positionable radially relative to the spindle, and a plurality of resilient springs corresponding in number to the plurality of support elements, each spring being disposed between two adjacent support elements and connected at opposite ends of the spring respectively to the two adjacent support elements for resiliently urging the support elements radially outwardly from the spindle.

20. The pallet of claim 19, further comprising means for supporting each spring essentially against radially inward deflection and against lateral deflection between its said ends.

21. The pallet of claim 19 wherein each said spring is a bar spring.

22. The pallet of claim 19 wherein each said spring is a torsion spring.

23. The pallet of claim 19 wherein said ends of each spring comprise arms which extend in laterally opposite directions from one another.

24. The pallet of claim 19 wherein the spindle defines slots and the support elements comprise fins which extend through the spindle slots, each fin having stops which cannot pass through the respective slot to limit radially outward movement of the fins.

25. The pallet of claim 24 wherein the stops comprise extending portions at opposite ends of the fins.

26. The pallet of claim 24 wherein the stops comprise lateral enlargements of the fins.

27. The pallet of claim 19 wherein the support elements are tapered at an outward end of the spindle opposite the base plate to facilitate mounting the textile yarn tube.

* * * * *